US009138090B2

(12) United States Patent
Horian et al.

(10) Patent No.: US 9,138,090 B2
(45) Date of Patent: Sep. 22, 2015

(54) ELECTRONIC ARTICLE DISPENSER

(71) Applicants: James G. Horian, Newport Coast, CA (US); Joseph Sandor, Newport Beach, CA (US)

(72) Inventors: James G. Horian, Newport Coast, CA (US); Joseph Sandor, Newport Beach, CA (US)

(73) Assignee: Metro Bay Products, Inc., Costa Mesa, CA (US)

( * ) Notice: Subject to any disclaimer, the term of this patent is extended or adjusted under 35 U.S.C. 154(b) by 88 days.

(21) Appl. No.: 13/841,507

(22) Filed: Mar. 15, 2013

(65) Prior Publication Data

US 2014/0263394 A1 Sep. 18, 2014

(51) Int. Cl.
*A47G 21/12* (2006.01)
*A47G 19/30* (2006.01)

(52) U.S. Cl.
CPC ..... *A47G 21/12* (2013.01); *A47G 21/184* (2013.01)

(58) Field of Classification Search
USPC ..... 221/192, 210, 254, 258, 263, 268
See application file for complete search history.

(56) References Cited

U.S. PATENT DOCUMENTS

| | | | | | |
|---|---|---|---|---|---|
| 540,220 | A * | 5/1895 | Henry | 131/250.1 |
| 541,853 | A * | 7/1895 | Hart | 221/142 |
| 859,009 | A * | 7/1907 | Packer et al. | 131/250.1 |
| 961,066 | A * | 6/1910 | Behler | 221/192 |
| 1,094,324 | A * | 4/1914 | Goebel | 312/31 |
| 1,159,195 | A * | 11/1915 | Eden | 221/238 |
| 1,199,244 | A * | 9/1916 | Beyer | 221/192 |
| 1,220,415 | A * | 3/1917 | Grand | 312/31 |
| 1,289,112 | A * | 12/1918 | Byer | 221/192 |
| 1,454,529 | A * | 5/1923 | Zebra | 221/102 |
| 1,803,536 | A * | 5/1931 | Nenna | 221/93 |
| 4,998,644 | A * | 3/1991 | Pan | 221/24 |
| 5,067,631 | A * | 11/1991 | Baba | 221/254 |
| 8,042,707 | B1 * | 10/2011 | Hopwood | 221/192 |
| 8,186,543 | B1 * | 5/2012 | Hopwood | 221/192 |
| 2014/0117036 | A1 * | 5/2014 | Smith | 221/1 |

* cited by examiner

*Primary Examiner* — Gene Crawford
*Assistant Examiner* — Kelvin L Randall, Jr.
(74) *Attorney, Agent, or Firm* — Stetina Brunda Garred & Brucker

(57) ABSTRACT

An automatic sensing article/toothpick dispenser with sanitizing capability. The dispenser is configured to store a plurality of toothpicks in a hygienic storage compartment specifically designed to prevent contaminants from entering the storage compartment. The dispenser is further configured to automatically dispense the toothpicks individually in an unwrapped, ready-to-use configuration, wherein the dispenser is configured and adapted to mitigate contact between the user and the dispenser so as to reduce the likelihood that contaminants may be transferred from the user to the dispenser.

11 Claims, 9 Drawing Sheets

ELECTRONIC ARTICLE DISPENSER

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Technical Field of the Invention

The present invention relates generally to a toothpick dispenser, and more specifically to a hygienic toothpick dispenser including a storage chamber configured to protect the toothpicks from bacteria or other contaminants, and a dispensing element configured to dispense a toothpick in response to minimal engagement by the user, or in some cases no engagement at all, so as to avoid the transfer of contaminants from the user to the toothpicks stored therein.

2. Description of the Related Art

Toothpicks are widely used throughout the world to maintain a certain level of dental hygiene. Along these lines, toothpicks are commonly utilized after a meal as a tool for removing food particles from the spaces between a user's teeth so as to preserve the health and appearance of the teeth. Toothpicks are also used for stimulation of the gum, for removing film on teeth, and for similar dental hygienic purposes. Removal of tooth film covering the teeth in the area towards the gum margin is particularly important for preventing dental disease.

Most conventional toothpicks are made of wood or plastic and are shaped as an elongated body with a relatively small transverse cross sectional area, wherein the elongated body terminates to define one or two distal tips for insertion in the mouth in order that it may be manually controlled to maneuver around the teeth and gum to serve its purpose, i.e., to clean and stimulate the gum. While in use, the toothpick is typically held between the fingers to be manipulated for producing the necessary movement.

Given the widespread use of toothpicks, several toothpick dispensing devices and techniques have been developed for storing and dispensing toothpicks in public locations, such as restaurants, cafeterias, cafes, and the like. A primary concern associated with public storing and dispensing of toothpicks is to maintain the toothpick in a sanitary environment until the toothpick is dispensed. In this regard, it is undesirable to simply place several toothpicks in an open container wherein users may grasp at exposed toothpicks because there is a concern that contaminants may be transferred from the user's hand to the toothpicks, which may be picked up by subsequent users. Furthermore, the toothpicks may inadvertently be spilled on the floor, requiring disposal of the toothpicks before they can be used.

To mitigate this concern, some toothpicks are individually wrapped in paper or cellophane to shield the toothpick from contaminants. The wrapper typically includes two opposed sheets, wherein the peripheral edges of the sheets are then joined to form an internal cavity where the toothpick resides. To access the toothpick, the wrapper is torn and the toothpick is removed therefrom.

Although individually wrapping the toothpicks mitigates some of the concern associated with the transfer of contaminants to the toothpicks, there is an undesirable cost associated with wrapping the toothpicks, particularly in view of the high volume of toothpicks used worldwide.

Therefore, toothpick dispensers have been developed which allow for bulk storage of unwrapped toothpicks and individual dispensing of the toothpicks. One of the most common toothpick dispensers utilized in the field is a dispenser which includes a storage box for storing the toothpicks, and a knob rotatably coupled to the storage box. The knob is configured to rotate relative to the storage box, is typically cylindrical and includes an axial slot formed therein which receives a toothpick from a storage box as the knob rotates and carries the toothpick out of the storage box and dispenses the toothpick into the dispensing tray.

Although the "knob-type" toothpick dispenser offers several economic advantages over individually wrapping the toothpicks, there are also certain deficiencies associated therewith. For instance, when the user reaches for the toothpick, the user oftentimes contacts the external surface of the knob, which in turn, may transfer contaminants from the user to the knob, which may ultimately contaminate any toothpick subsequently dispensed by the knob, or subsequent users who come in contact with the knob.

Therefore, there is a need in the art for an improved toothpick dispenser which is configured to store a plurality of toothpicks in a hygienic environment and dispense the toothpicks with minimal or no contact between the dispenser and the user's hand.

BRIEF SUMMARY OF THE INVENTION

There is provided a hygienic toothpick dispenser configured to store a plurality of toothpicks in a hygienic storage compartment specifically designed to prevent contaminants from entering the storage compartment. The dispenser is further configured to dispense the toothpicks individually in an unwrapped, ready-to-use configuration, wherein the dispenser is configured and adapted to mitigate contact between the user and the dispenser so as to reduce the likelihood that contaminants may be transferred from the user to the dispenser.

According to one embodiment, the hygienic toothpick dispenser includes a storage container having an inner storage compartment configured for storing a plurality of toothpicks. The storage container includes an external dispensing slot formed therein and in communication with the inner storage compartment. A dispensing element is operatively coupled to the storage container and includes a toothpick engagement portion defining an engagement cavity configured to be engageable with a single toothpick. The dispensing element is translatable relative to the storage container to transition between retracted and dispensing positions. As the dispensing element translates from the retracted position to the dispensing position, the dispensing element passes through the inner storage compartment, engages with a single toothpick, and extends through the external dispensing slot to dispense the toothpick.

The dispensing element may include a pair of engagement arms disposed in spaced relation to each other and which collectively define the engagement cavity. The dispensing element may additionally include a cutout extending between the pair of engagement arms to facilitate gripping of a dispensed toothpick by a user.

The dispensing element may include a rack gear portion, which is engageable with a pinion gear to effectuate translation of the dispensing element between the retracted position and the dispensing position.

The dispensing element may include a stop element for use in stopping the dispensing element when the dispensing element is in the dispensing position. The stop element may include an aperture formed in the dispensing element. The toothpick dispenser may further include a stopping sensor coupled to the storage container and configured to emit a signal along an emitting axis. The stopping sensor may be configured to detect when the dispensing element is in the dispensing position by detecting when the signal extends through the stop element aperture.

The toothpick dispenser may additionally include an activation sensor coupled to the storage container and in operative communication with the dispensing element. The activation sensor may be configured to detect placement of a user's hand adjacent the activation sensor and initiate movement of the dispensing element from retracted position toward the dispensing position in response to such detection.

The toothpick dispenser may additionally include a sanitizing element in optical communication with the inner storage compartment for at least partially cleansing items in the inner storage compartment. The sanitizing element may include an ultraviolet emitter configured to emit ultraviolet light at a wavelength that has germicidal effect. The storage container may be formed from acrylic or clear plastic.

The storage container may include a funneling element including a pair of opposed, sloped walls configured to urge the plurality of toothpicks toward the dispensing element when the dispensing element is in the retracted position. The pair of opposed, sloped walls may be separated to define a funneling slot, wherein the funneling slot and dispensing slot are aligned along a common axis.

According to another embodiment of the present invention, there may be provided a storage and dispensing element for other articles, such as straws, candy, toys, utensils, or other items wherein hygienic storage and dispensing is desired.

The present invention is best understood by reference to the following detailed description when read in conjunction with the accompanying drawings.

BRIEF DESCRIPTION OF THE DRAWINGS

These as well as other features of the present invention will become more apparent upon reference to the drawings wherein.

Common reference numerals are used throughout the drawings and detailed description to indicate like elements.

DETAILED DESCRIPTION OF THE INVENTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
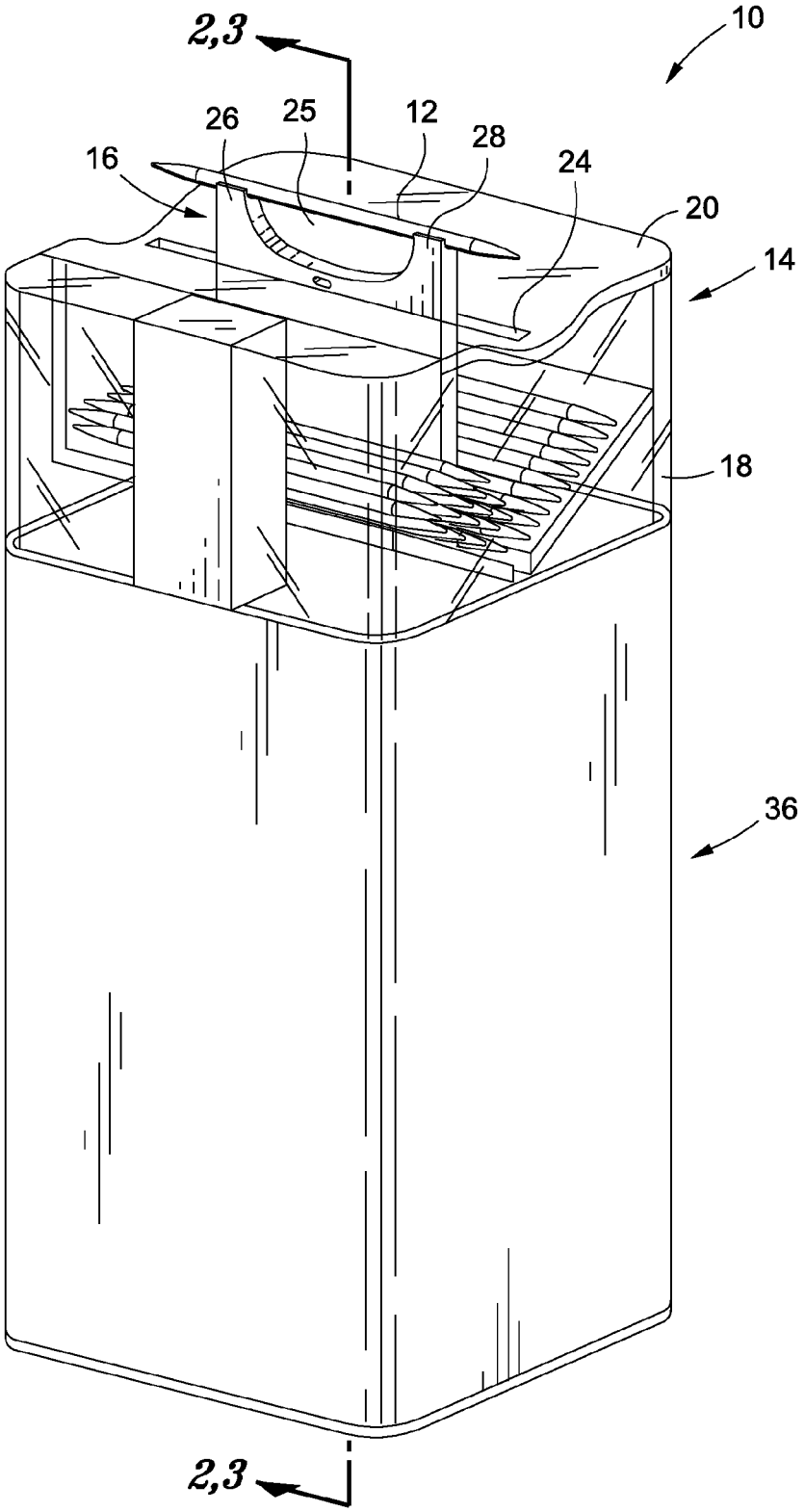
FIG. 1 is an upper perspective view of a hygienic toothpick dispenser constructed in accordance with an embodiment of the present invention.

Referring now to FIG. 1, wherein the showings are for purposes of illustrating a preferred embodiment of the present invention only, and is not for purposes of limiting the same, there is shown a toothpick dispenser 10 specifically configured and adapted to hygienically store and dispense a toothpick 12. The toothpick dispenser 10 includes a storage container 14 configured to store a plurality of toothpicks 12, and a mechanical dispensing element 16 which is movable relative to the storage container 14 between a retracted position and a dispensing position. As the dispensing element 16 moves from the retracted position to the dispensing system, the dispensing element 16 engages with a single toothpick 12 and lifts the toothpick 12 out of the storage container 14 for retrieval by a user. The storage container 14 defines a substantially enclosed inner storage compartment 15 within which the toothpicks 12 are hygienically stored for subsequent dispensing.

By dispensing only a single toothpick 12 from the storage container 14, the user does not reach into the storage container 14 to grab a toothpick 12. Instead, the dispensing element 16 lifts the toothpick 12 out of the storage container 14 for easier access by the user. Thus, the toothpicks 12 stored in the storage container 14 are not directly exposed to any germs, bacteria, viruses, or other contaminants which may be present on the user's hands. Furthermore, as will be explained in more detail below, the toothpick dispenser 10 may be configured to emit ultraviolet light at a wavelength which has a germicidal effect within the storage container 14, specifically the articles stored within the storage container 14, to provide further hygienic protection.

In addition to the hygienic benefits associated with the toothpick dispenser 10, the dispenser 10 is specifically configured and adapted to present the dispensed toothpick 12 in a ready-to-use condition. In this regard, the user is not required to remove the toothpick 12 from a wrapper before using the toothpick 12. Rather, the toothpick 12 is lifted out of the storage container 14 and may be grasped by the user for immediate use.

Figure 5:
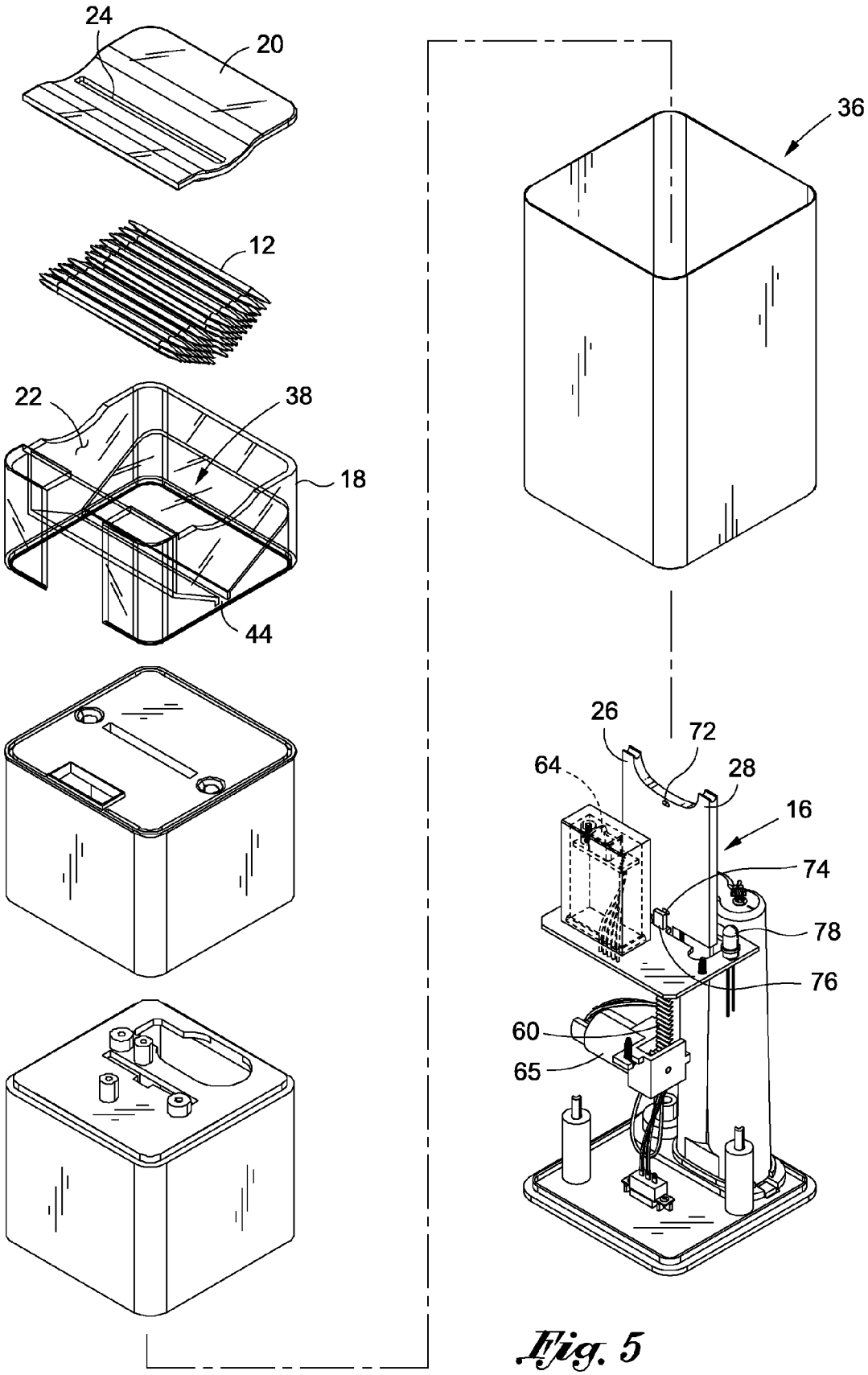
FIG. 5 is an exploded upper perspective view of the toothpick dispenser.

The storage container 14 generally includes a storage body 18 and a lid 20 removably engageable with the storage body 18. The storage body 18 includes an upper opening 22 (see FIG. 5) which is closed by the lid 20 when the lid 20 is engaged with the storage body 18. The lid 20 includes a longitudinal slot 24 formed therein, with the slot 24 being configured to allow a single toothpick 12 to pass therethrough for dispensing.

The internal surfaces of the storage body 18 may be configured to align the toothpick 12 with the longitudinal axis of the slot 24 to facilitate dispensing of the toothpick 12 through the slot 24. In this regard, the storage body 18 may be configured to store the toothpicks in an orientation that is parallel to the longitudinal axis of the slot 24.

The storage container 14 rests on top of a housing 36 which houses several components used during the operation of the toothpick dispenser 10, as will be described in more detail below.

Figure 6:
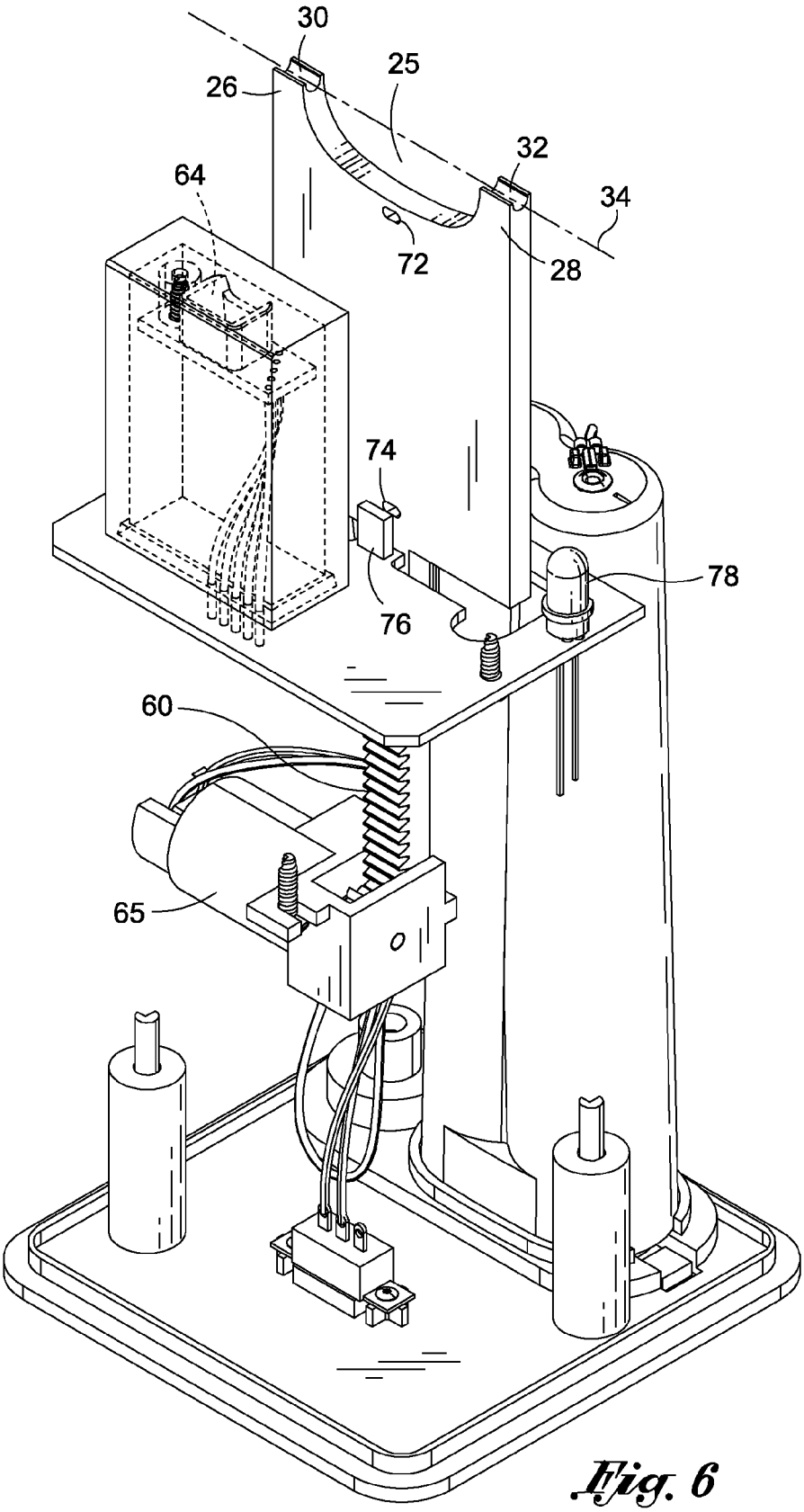
FIG. 6 is an enlarged upper perspective view of a sensing and dispensing assembly, which forms part of the hygienic toothpick dispenser.
Figure 7:
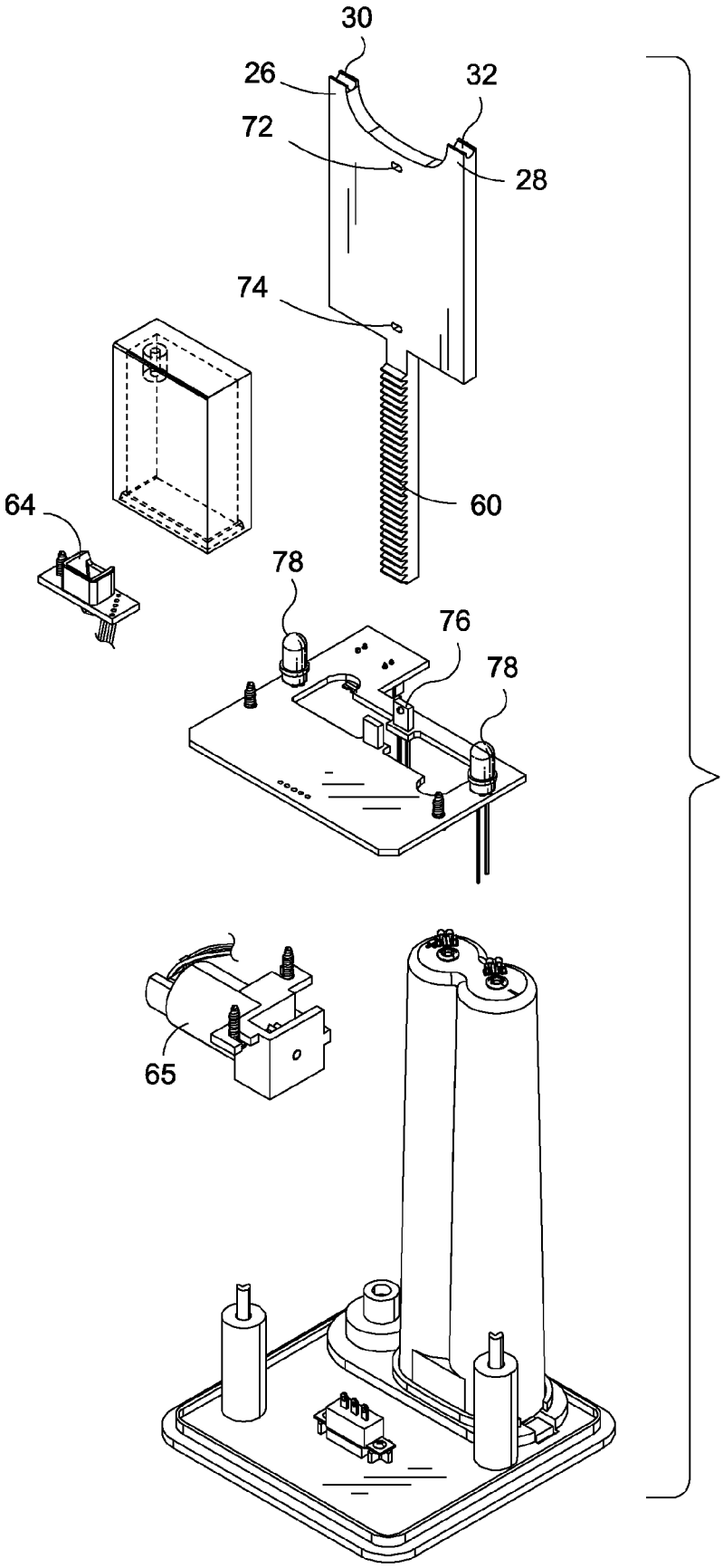
FIG. 7 is an exploded upper perspective view of the sensing and dispensing assembly depicted in FIG. 6.

The dispensing element 16 is configured to be advanced through the slot 24 when the dispensing element 16 is in the dispensing position, as is shown in FIG. 1. The dispensing element 16 is preferably configured to engage with a single toothpick 12 as the dispensing element 16 moves from the retracted position toward the dispensing position and passes through the inner storage compartment 15. In the embodiment depicted in FIG. 1, the dispensing element 16 includes a pair of engagement arms 26, 28 disposed adjacent opposed lateral end portions of the dispensing element 16. Each engagement arm 26, 28 defines a respective toothpick engagement cavity 30, 32 (see FIG. 6), wherein the engagement cavities 30, 32 are coaxially aligned along a toothpick engagement axis 34 (see FIG. 6). The engagement arms 26, 28 reside on opposed sides of an arcuate cutout 25, which is formed to allow the user to retrieve the toothpick 12 at a middle portion thereof without contacting the dispensing element 16 to mitigate contamination of the dispensing element 16.

It is contemplated that certain embodiments of the dispenser 10 may include a moveable lid coupled to the storage container 14 and extendable over the slot 24. The movable lid may be configured to move in concert with the dispensing element 16, such that the lid moves from a closed position to an open position to uncover the slot 24 as the dispensing element 16 moves from the retracted position to the dispensing position. The moveable lid may move from the open position to the closed position as the dispensing element 16 moves from the dispensing position toward the retracted position. When the moveable lid is closed, the slot 24 is preferably covered to prevent dust, particles, germs or other contaminants from entering the inner storage compartment 15 through the slot 24.

Figure 2:
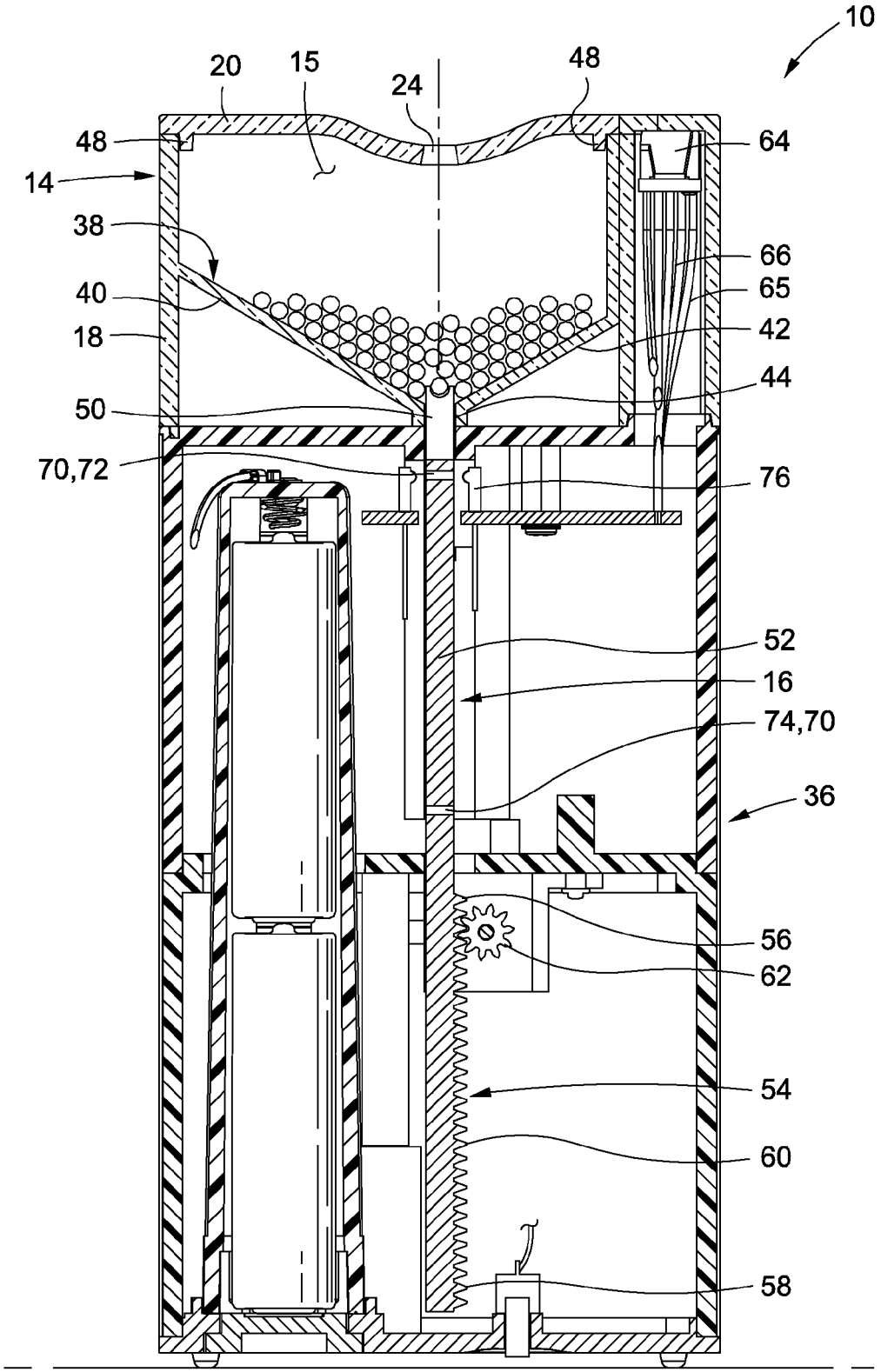
FIG. 2 is a side sectional view of the toothpick dispenser with a dispensing element in a retracted position.
Figure 3:
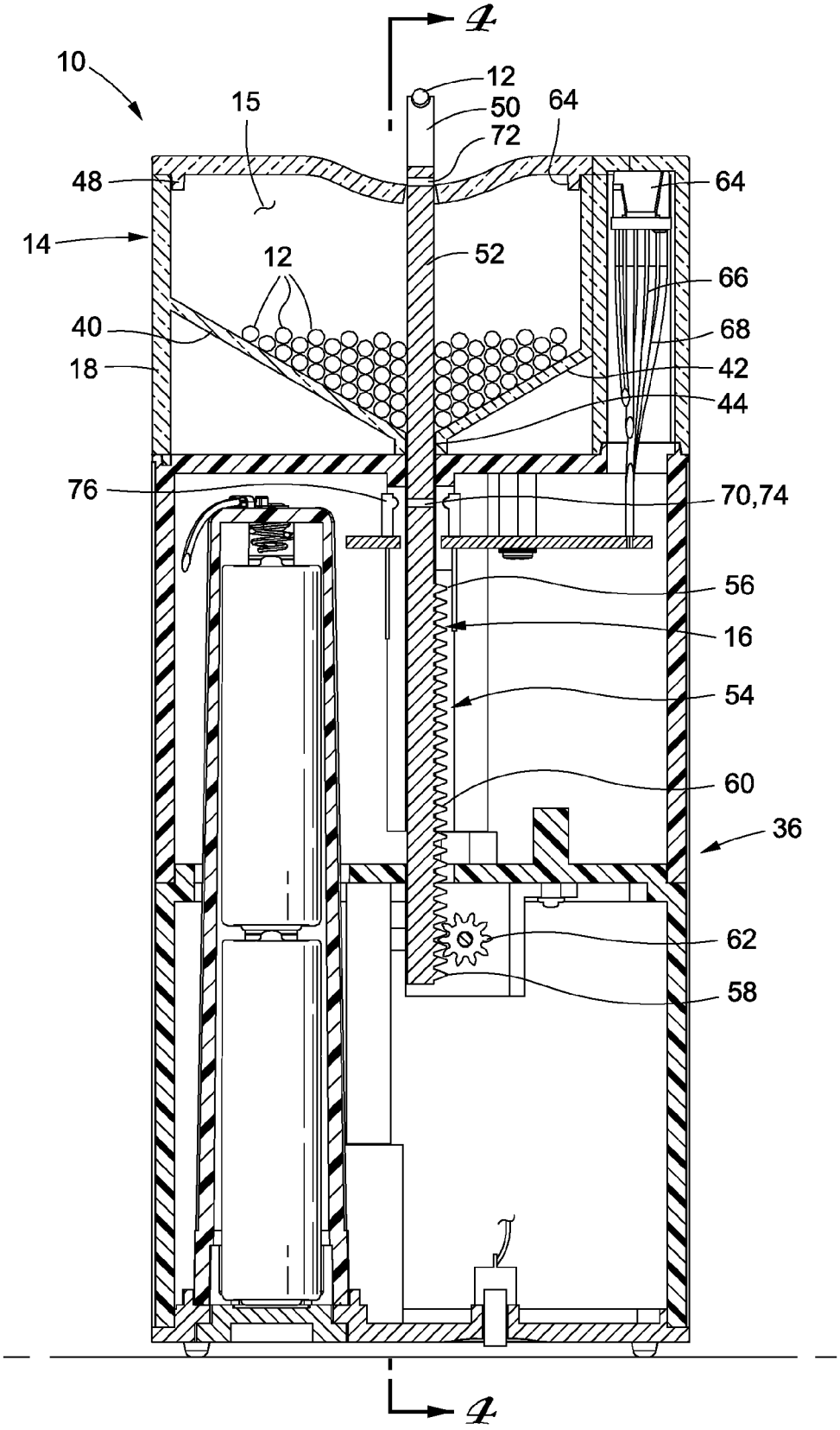
FIG. 3 is a side sectional view of the toothpick dispenser with the dispensing element in a dispensing position.

Referring now specifically to FIG. 2, there is depicted a side sectional view of the toothpick dispenser 10 with the dispensing element 16 in the retracted position, which is contrasted with the dispensing element 16 shown in the dispensing position in FIGS. 1 and 3. In the retracted position, the dispensing element 16 is generally contained within the toothpick dispenser 10 and may be reloaded with a new toothpick 12 and readied for subsequent dispensing. Along these lines, the storage container 14 preferably includes a funneling element 38 for funneling the toothpicks 12 toward the dispensing element 16 when the dispensing element 16 is in the retracted position. In the exemplary embodiment, the funneling element 38 includes a pair of opposed walls 40, 42 shaped like a hopper to funnel the toothpicks 12 toward the retracted dispensing element 16. The pair of walls 40, 42 are spaced apart to define a gap 44 through which the dispensing element 16 may extend.

The dispensing element 16 translates along a translation axis 46 which extends through the gap 44 and the slot 24. The lid 20 may include one or more guide tabs 48 which ensure that the lid 20 is placed on the storage body 18 in a manner such that the translation axis 46 is aligned with the slot 24.

The dispensing element 16 includes a toothpick engagement portion 50 disposed at an end portion thereof wherein the toothpick engagement portion 50 includes the toothpick engagement arms 26, 28. The toothpick engagement portion 50 is coupled to an intermediate portion 52, which in turn, is coupled to a rack gear portion 54 disposed at an end portion of the dispensing element 16. The rack gear portion 54 extends from a first end portion 56 to a second end portion 58 and includes a plurality of gear teeth 60 between the first and second end portions 56, 58. The rack gear portion 54 engages with a pinion gear 62, which is powered by a motor 65. The rack gear portion 54 and pinion gear 62 cooperatively engage with each other in a manner similar to conventional rack and pinion gear systems to communicate rotations of the pinion gear 62 into translation of the rack gear portion 54, thereby transitioning the dispensing element 16 between the retracted and dispensing positions.

As shown in FIG. 2, the pinion gear 62 is disposed adjacent the first end portion 56 of the rack gear portion 54 when the dispensing element 16 is in the retracted position. FIG. 3 shows the dispensing element 16 in the dispensing position, wherein the rack gear portion 54 has translated relative to the pinion gear 62 such that the pinion gear 62 is now disposed adjacent the second end portion 58 of the rack gear portion 54.

According to one embodiment, the toothpick dispenser 10 includes an actuator 64 for actuating the dispensing element 16. The actuator 64 is configured to detect the placement of a user's hand adjacent the toothpick dispenser 10 and initiate rotation of the pinion gear 62 in response thereto. In the exemplary embodiment, the pinion gear 62 rotates in a clockwise direction to transition the dispensing element 16 from the retracted position toward the dispensing position, and in a counter-clockwise direction to transition the dispensing element 16 from the dispensing position toward the retracted position.

The activation sensor 64 may employ infrared detection technology known by those skilled in the art. The activation sensor 64 may include other motion/presence detection technologies including ultrasonic detection, or microwave detection. For instance, the activation sensor 64 may be configured to detect the user's hand when the user's hand is within six inches of the activation sensor 64. The activation sensor 64 is disposed within the storage container 14 and is positioned to define a sensing field adjacent the lid 20 of the storage container 14. The activation sensor 64 is electrically connected to power and data wires 66, 68 for communicating power and data to and from the activation sensor 64. The power wires 66 extend between the activation sensor and a power source, preferably an internal power source (e.g., batteries) to power the activation sensor 64. The data wires 68 extend between the activation sensor and a pinion control unit 65, i.e. a motor, for controlling the pinion 62.

Although a preferred embodiment of the dispenser 10 includes an activation sensor 64 which detects placement of the user's hand adjacent the dispenser 10, and thus, does not require physical contact between the user and the dispenser 10 (so as to reduce the transfer of contaminants from the user to the dispenser 10), it is contemplated that in other embodiments, the activation sensor 64 may include a button or switch which may be depressed to actuate the dispensing element 16. The activation button may be easily accessible, and preferably positioned away from the slot 24 reduce the likelihood that contaminants from the user's hand would pass through the slot 24 and into the storage compartment.

While the activation sensor 64 is used to initiate movement of the dispensing element 16, the dispensing element 16 includes a stop member 70 used for stopping the dispensing element 16. According to one embodiment, the stop member 70 includes a first aperture 72 formed within the dispensing element 16 for stopping the dispensing element 16 in the retracted position. A second aperture 74 is formed within the dispensing element 16 for stopping the dispensing element 16 in the dispensing position. The first and second apertures 72, 74 are used in connection with a stopping sensor 76 which senses the first and second apertures 72, 74 to stop the dispensing element 16 in the retracted or dispensing positions. In particular, the stopping sensor 76 emits a signal along an emitting axis such that when the emitting axis passes through one of the first and second apertures 72, 74, the dispensing element 16 is stopped. For instance, as the dispensing element 16 moves from the dispensing position toward the retracted position, the signal emitted by the stopping sensor 76 is at least partially blocked or impeded by the intermediate portion 52 of the dispensing element 16. However, when the first aperture 72 is aligned with the emitting axis, the signal emitted by the stopping sensor 76 may pass through the first aperture 72 to indicate that the dispensing element 16 is in the completely retracted position. Conversely, as the dispensing element 16 moves from the retracted position toward the dispensing position, the signal emitted by the stopping sensor 76 is blocked by the intermediate portion until the second aperture 74 is aligned with the emitting axis to allow the signal to pass through the second aperture. When the emitting axis is aligned with the second aperture 74, and the stopping sensor signal passes through the second aperture 74, the dispensing element 16 is in the dispensing position.

Although the foregoing describes an embodiment which includes first and second apertures 72, 74 as the stop member 70, it is contemplated that other embodiments may include mechanically actuated switches to detect dispensing and retracted positions. Furthermore, a control unit (i.e. a circuit board) may also be used which controls the movement of the dispensing element 16 via preprogrammed instructions. For instance, the pinion gear 62 may be instructed to rotate a certain number of rotations to transition the dispensing element 16 from the retracted position to the dispensing position and vice versa.

Figure 4:
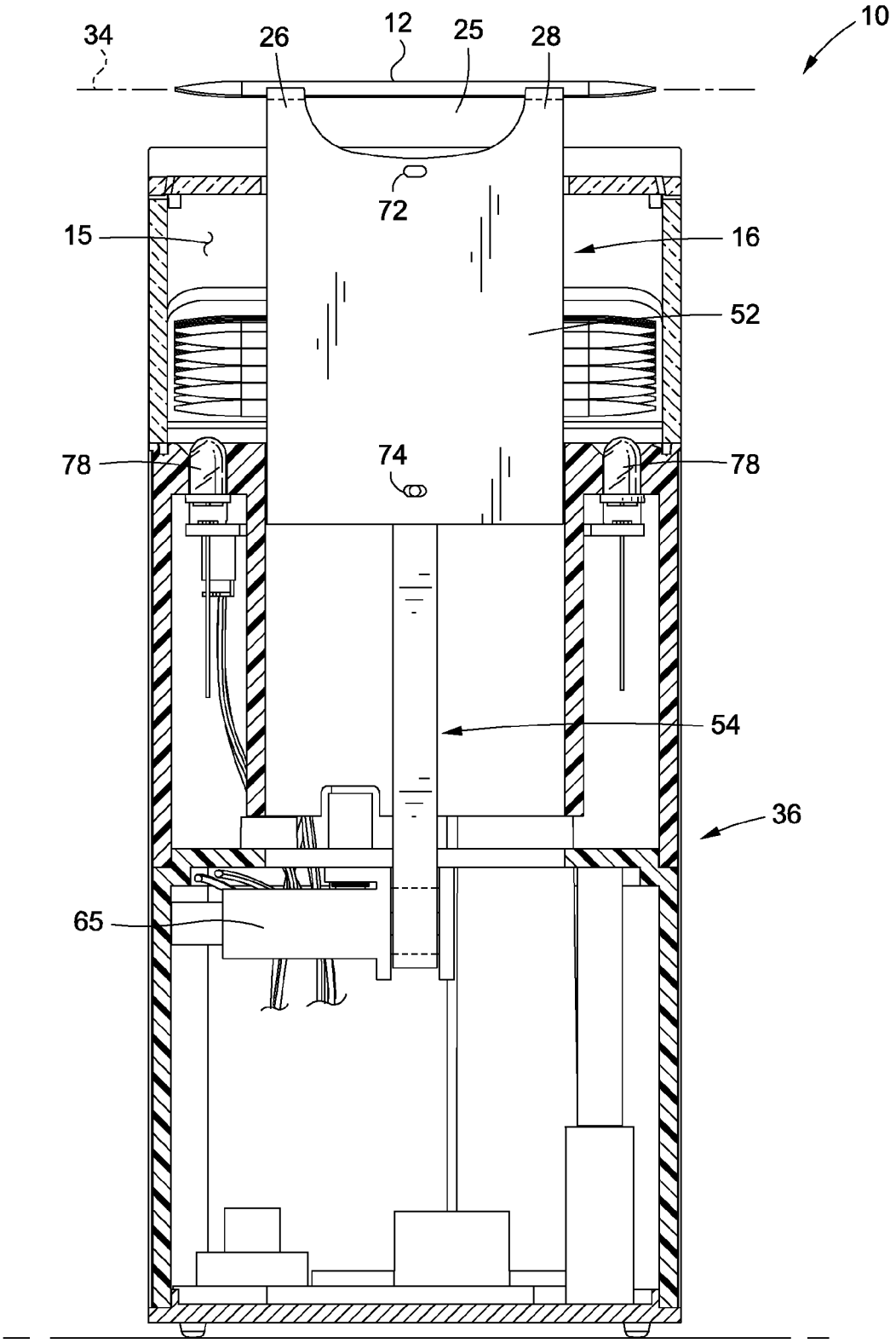
FIG. 4 is a front sectional view of the toothpick dispenser with the dispensing element in the dispensing position.

According to one aspect of the present invention, the dispenser 10 includes at least one sanitizing light element 78 (see FIG. 4) in optical communication with the storage container 14 to have germicidal effect on articles within the inner storage compartment 15. The exemplary embodiment includes two sanitizing light elements 78, although fewer than two, or more than two sanitizing light elements 78 may be used, depending on the size of the dispenser 10. The sanitizing light element 78 may kill some or most bacteria/contaminants on the walls of the storage body 18, lid 20, funneling element 38, dispensing element 16, or toothpicks 12.

According to one embodiment, the sanitizing light element 78 is an ultraviolet light emitting diode (LED) configured to emit light at a wavelength which kills some or most bacteria and/or other contaminants. In one implementation, the wavelength is approximately 310 nm, although other wavelengths known by those skilled in the art may be used without departing from the spirit and scope of the present invention.

The dispenser 10 preferably employs direct illumination to communicate light to the articles stored within the container. However, additional light elements, direct or indirect, may be employed to illuminate the compartment.

The sanitizing light element 78 may be configured to emit light every time the dispensing element 16 is actuated so as to ensure the toothpicks 12 being dispensed are as sterile as possible. The light element 78 may remain illuminated until the dispensing element 16 completes its cycle and returns to the retracted position. In this regard, if any contaminants are transferred to the dispensing element 16 while the dispensing element 16 is in the dispensing position, the dispensing element 16 may be at least partially sterilized upon its retraction through the storage body 18 as it is exposed to the light emitted by the light element 78.

The light element 78 may also be configured to emit light at regular intervals, even during periods of non-use, so as to maintain a sterile and hygienic environment within which the toothpicks 12 are stored. For instance, every five minutes, the light element 78 may emit light for several seconds, or long enough to maintain the desired level of sterilization. The frequency at which the light element 78 cycles between the ON and OFF states may be varied without departing from the spirit and scope of the present invention.

With the basic structural features of the toothpick dispenser 10 described above, the following discussion will focus on operation thereof. Prior to dispensing, the toothpick dispenser 10 is loaded with toothpicks 12 by removing the lid 20 from the storage body 18 and placing a plurality of toothpicks 12 in the inner storage compartment 15. The toothpicks 12 are preferably placed in the storage compartment 15 such that the longitudinal dimension of the toothpicks 12 are aligned with the longitudinal dimension of the slot 24. Once the toothpicks 12 are placed in the storage body 18, the lid 20 is placed on the storage body 18 to close the storage compartment 15. With the dispenser 10 loaded with toothpicks 12, the dispenser 10 may be placed in a convenient location for use (i.e., at a hostess stand).

When a user wants to retrieve a toothpick 12 from the dispenser 10, the user places his hand near the slot 24 to actuate the dispensing element 16. Preferably, the user's hand is detected by the activation sensor 64, which causes the dispensing element 16 to move from the retracted position to the dispensing position. In particular, the activation sensor 64 sends an activation signal to the motor 65 coupled to the pinion gear 62 so as to rotate the pinion gear 62 in a direction which causes the dispensing element 16 to rise from the retracted position. Furthermore, the activation signal may also be communicated to the sanitizing light element 78 to activate the light element 78 for sanitizing the toothpick 12 along with the dispensing element 16.

As the pinion gear 62 rotates, the dispensing element 16 transitions from the retracted position toward the dispensing position and a toothpick 12 is lifted by the engagement arms 26, 28 along the translation axis 46 and through the slot 24. When the second aperture 74 is aligned with the stopping sensor 76, the dispensing element 16 is in the dispensing position and a stop signal is communicated to the pinion gear motor 65 to stop rotation of the pinion gear 62.

When the dispensing element 16 is in the dispensing position, the toothpick 12 may be easily retrieved therefrom by the user, and the dispensing element 16 may return to the retracted position. The activation sensor 64 may be configured to detect when the user moves his hand away from the dispenser 10 after retrieving the toothpick 12 to initiate rotation of the pinion gear in an opposite direction for retraction of the dispensing element 16 into the storage container 14. Alternatively, the dispenser 10 may be programmed to maintain the dispensing element 16 in the dispensing position for a prescribed period of time before the dispensing element 16 is transitioned back to the retraced position. For instance, the dispensing element 16 may remain in the dispensing position for 10 seconds before the pinion gear 62 begins rotating to return the dispensing element 16 to the retracted position.

As the dispensing element 16 moves through the storage container 14 from the dispensing position toward the retracted position, it traverses through the plurality of toothpicks 12 located in the inner storage compartment, and becomes engaged with one of the toothpicks 12. In this regard, one of the toothpicks 12 is received in the toothpick engagement cavities 30, 32 on the engagement arms 26, 28 to reload the dispensing element 16 for subsequent dispensing.

The dispensing element 16 continues toward the retracted position until the first aperture 72 is aligned with the stopping sensor 76, at which time the stopping sensor 76 generates a signal which is communicated to the pinion gear motor 65 to cease operation. At this point, the dispensing element 16 is in the retracted position and is ready for the next cycle.

As described above, several aspects of the toothpick dispenser 10 are designed to offer several advantages over conventional toothpick dispensing devices. More specifically, in contrast to conventional dispensing devices which require the user to contact or engage with the device to dispense a toothpick, the dispenser 10 shown and described herein is designed to operate independent of any contact with the user, since dispensing is activated automatically in response to detection of the user's hand in close proximity to the dispenser 10. Furthermore, the dispensing element 16 is specifically configured with a cutout 25 to allow the user to grab the toothpick 12 without contacting any portion of the dispenser 10. By reducing or eliminating contact between the user and the dispenser 10, the transfer of bacteria, viruses and other contaminants from one user to the next is significantly reduced.

Another distinguishable feature of the toothpick dispenser 10 is that it includes a sanitizing element, i.e., the sanitizing light element 78, which may provide a germicidal effect to articles stored within the storage container 14, the dispensing element 16 and the toothpicks stored within the storage container 14. Thus, if any contaminants do happen to enter the storage compartment 15, the sanitizing light element 78 is operative to reduce the number of contaminants.

Figure 8:
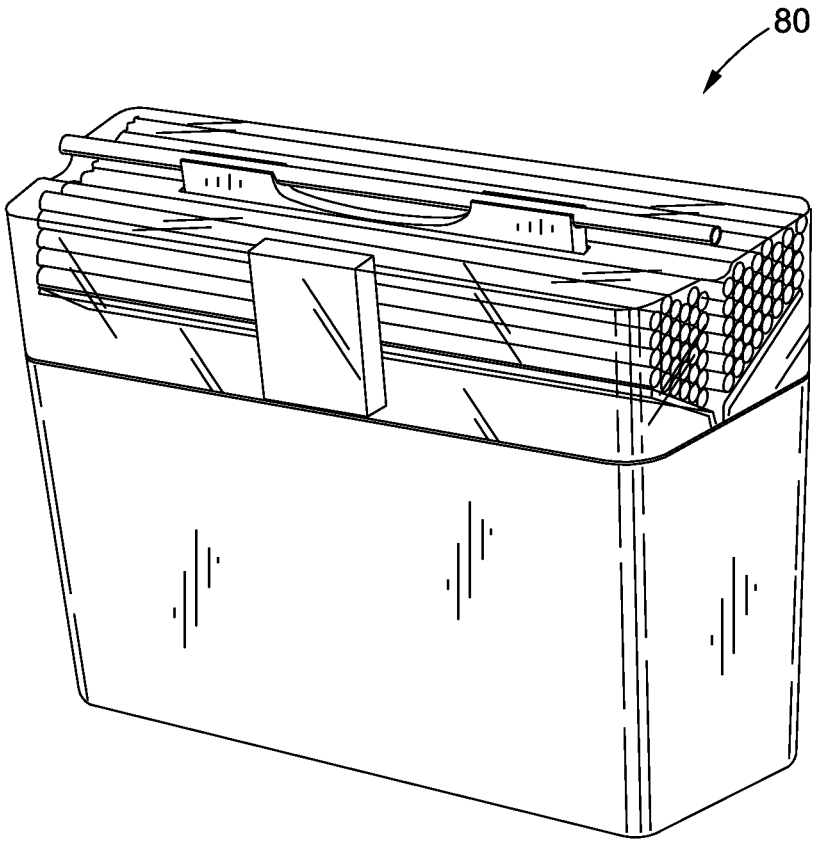
FIG. 8 is an upper perspective view of a straw dispenser constructed in accordance with an embodiment of the present invention.

Although the foregoing describes a dispenser specifically configured and adapted for dispensing toothpicks 12. It is contemplated that other embodiments may be configured for dispensing other articles. Referring now specifically to FIG. 8, there is shown a dispenser 80 configured to dispensing other elongate articles, such as straws. The straw dispenser 80 is similar to the toothpick dispenser 10 described above, and shown in FIG. 1-7, with the primary distinction being that the straw dispenser 80 includes a storage compartment and the dispensing arm specifically configured and adapted to accommodate the longer dimensions of the straw. In this regard, those skilled in the art will recognize that the straw dispenser 80 operates in a manner similar to the toothpick dispenser 10 described above. The straw dispenser 80 is configured to provide similar germicidal effect on the straws stored within the storage compartment.

Figure 9:
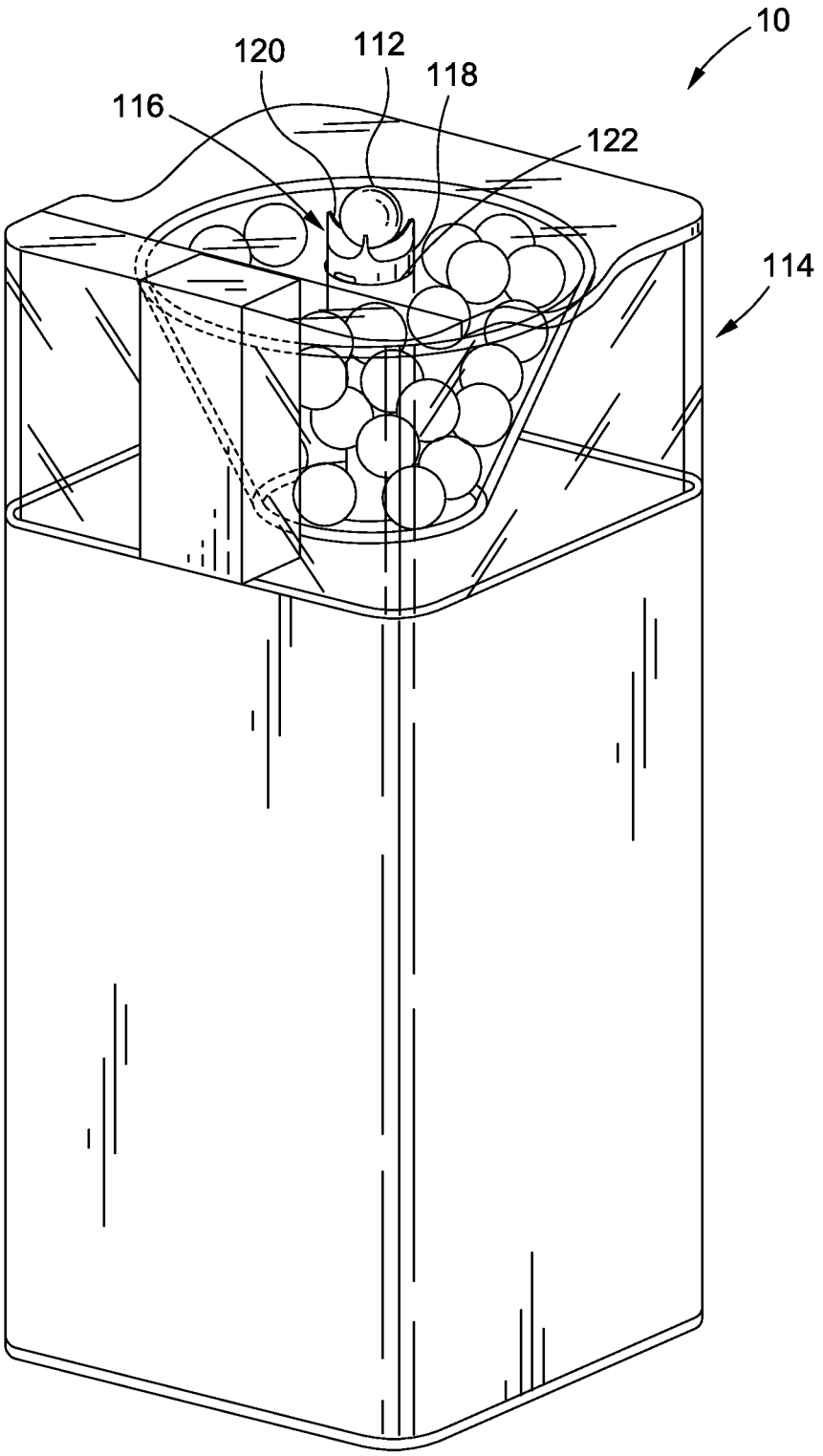
FIG. 9 is an upper perspective view of a candy dispenser constructed in accordance with an embodiment of the present invention.

Referring now specifically to FIG. 9, there is shown a dispenser 110 configured for dispensing candy 112, such as gumballs, chocolates, or other confections. The candy dispenser 110 operates in a manner similar to the toothpick dispenser 10 described above, and thus, the following discussion will focus on the primary points of distinction between the toothpick dispenser 10 and the candy dispenser 110.

According to one embodiment, the candy dispenser 110 includes a storage container 114 having an inner storage compartment specifically configured and adapted for storing a plurality of candy pieces 112. The storage container 114 includes an inverted, frusto-conical inner storage compartment for placement and storage of the candies 112.

A candy dispensing element 116 operates in a manner similar to the toothpick dispensing element 116, and includes a candy engagement portion 118 defining a cavity 120 for receiving a piece of candy 112. Preferably, the cavity 120 is substantially complimentary in shape to the size and shape of the candies 112, although other embodiments may include a cavity 120 that is not complimentary to the size and shape of the candies 112. In one embodiment, the candy engagement portion 118 is a multi-pronged element that engages with the candy 112 and allows the user to easily grasp the candy 112 without directly contacting the multi-pronged element.

The storage container 114 includes an opening 122 through which the candy 112 is dispensed by the dispensing element 116. The dispensing element 116 transitions between retracted and dispensing positions to dispense the candy 112. As the dispensing element 116 moves from the retracted position toward the dispensing position, the dispensing element 116 is advanced through the opening 122 formed in the storage container 114 to remove the piece of candy 112 from the storage container 114. Subsequently, the dispensing element 116 is retracted back into the storage container 114 through the opening 122 and into the retracted position. As the dispensing element 116 passes through the storage compartment, another piece of candy 112 falls into the cavity 120 to reload the dispensing element 112 to ready the dispensing element 112 for the next cycle of dispensing. The shape of the inverse, frusto-conical storage compartment urges the candies toward the cavity 120 on the candy engagement portion 118 when the dispensing element 116 is in the retracted position.

Movement of the dispensing element 116 may be controlled by an activation sensor, as described above in relation to the toothpick dispenser 10. Furthermore, the candy dispenser 110 may additionally include one or more sanitizing light elements to sanitize the storage container 114, the candy 112, and the dispensing element 116, similar to those described above in relation to the toothpick dispenser 10.

The candy dispenser 110 offers many of the same advantages described above in relation to the toothpick dispenser 10. In particular, the candy dispenser 110 is configured to dispense candy 112 with minimal physical contact between the dispenser 110 and the user. Furthermore, the candy dispenser 110 actively sanitizes the candy 112 stored therein, as well as the components touching the candy 112.

In addition to toothpicks, straws, and candy, it is also contemplated that the dispensers described herein may be specifically configured and adapted to dispense other articles, including but not limited to, chopsticks, utensils, toys, medical devices, etc.

Additional modifications and improvements of the present invention may also be apparent to those of ordinary skill in the art. Thus, the particular combination of components and steps described and illustrated herein is intended to represent only certain embodiments of the present invention, and is not intended to serve as limitations of alternative devices and methods within the spirit and scope of the invention.

What is claimed is:

1. A hygienic toothpick dispenser comprising:

a storage container having an inner storage compartment configured for storing a plurality of toothpicks, the storage container having an external dispensing slot formed therein and in communication with the inner storage compartment;

a dispensing element operatively coupled to the storage container, the dispensing element having a toothpick engagement portion defining an engagement cavity configured to be engageable with a single toothpick, the dispensing element being translatable relative to the storage container to transition between retracted and dispensing positions, as the dispensing element translates from the retracted position to the dispensing position, the dispensing element passes through the inner storage compartment, engages with a single toothpick, and extends through the external dispensing slot to dispense the toothpick, wherein the dispensing element includes a stop element for use in stopping the dispensing element when the dispensing element is in the dispensing position, the stop element including an aperture formed in the dispensing element; and a sanitizing element in optical communication with the inner storage compartment for at least partially cleansing items in the inner storage compartment;

a stopping sensor coupled to the storage container and configured to emit a signal along an emitting axis, wherein the stopping sensor detects when the dispensing element is in the dispensing position by detecting when the optical signal extends through the stop element aperture.

2. The toothpick dispenser recited in claim 1, wherein the dispensing element includes a pair of engagement arms disposed in spaced relation to each other and which collectively define the engagement cavity.

3. The toothpick dispenser recited in claim 2, wherein the dispensing element includes a cutout extending completely between the pair of engagement arms to facilitate gripping of a dispensed toothpick by a user.

4. The toothpick dispenser recited in claim 1, wherein the dispensing element includes a rack gear portion, the toothpick dispenser further comprising:

a pinion gear engageable with the rack gear portion to effectuate translation of the dispensing element between the retracted position and the dispensing position.

5. The toothpick dispenser recited in claim 1, further comprising an activation sensor coupled to the storage container and in operative communication with the dispensing element, the activation sensor being configured to detect placement of a user's hand adjacent the activation sensor and initiate movement of the dispensing element from retracted position toward the dispensing position in response to such detection.

6. The toothpick dispenser recited in claim 1, wherein the sanitizing element includes an ultraviolet emitter configured to emit ultraviolet light at a wavelength having germicidal effect.

7. The toothpick dispenser recited in claim 1, wherein the storage container includes a funneling element including a pair of opposed, sloped walls configured to urge the plurality of toothpicks toward the dispensing element when the dispensing element is in the retracted position.

8. The toothpick dispenser recited in claim 7, wherein the pair of opposed, sloped walls are separated to define a funneling slot, the funneling slot and dispensing slot being aligned along a common axis.

9. The toothpick dispenser recited in claim 1, wherein the sanitizing element includes an ultraviolet light emitting diode (LED).

10. The toothpick dispenser recited in claim 9, wherein the ultraviolet LED is configured to emit light at a wavelength of approximately 310 nm.

11. The toothpick dispenser recited in claim 1, further comprising at least one light element configured to illuminate the inner storage compartment.

* * * * *